United States Patent [19]

Hess et al.

[11] Patent Number: 4,525,934

[45] Date of Patent: Jul. 2, 1985

[54] METHOD AND APPARATUS FOR DRYING MOISTURE-LADEN POWDER-LIKE PRODUCTS, PARTICULARLY OF STARCHES AND FLOURS

[75] Inventors: Dieter Hess, Kernen; Helmut Langenbacher, Stuttgart, both of Fed. Rep. of Germany

[73] Assignee: Werner & Pfleiderer, Stuttgart-Feuerbach, Fed. Rep. of Germany

[21] Appl. No.: 606,370

[22] Filed: May 2, 1984

Related U.S. Application Data

[63] Continuation of Ser. No. 328,821, Dec. 9, 1981, abandoned.

[30] Foreign Application Priority Data

Dec. 12, 1980 [DE] Fed. Rep. of Germany ..... 3046851

[51] Int. Cl.[3] ..... F26B 3/10

[52] U.S. Cl. ..... 34/10; 34/57 R; 34/57 E

[58] Field of Search ..... 34/10, 57 A, 57 D, 57 E, 34/57 R; 110/245; 432/15, 58

[56] References Cited

U.S. PATENT DOCUMENTS 3,789,513 2/1974 Mark ..... 34/57 E

FOREIGN PATENT DOCUMENTS 588688 11/1933 Fed. Rep. of Germany .

943477 12/1963 United Kingdom ..... 34/57 E

*Primary Examiner*—Larry I. Schwartz

*Attorney, Agent, or Firm*—Roberts, Spiecens & Cohen

[57] ABSTRACT

Method for drying of moisture-containing powder-like products, particularly starches and flours, in a flow tube passed-through by conveying gas, in the interior of which—distributed over the entire length of a central and rotary arranged tube—there are provided helically extending guide members for the production of a helical path of the feeding gas stream and for the distribution of the product stream is characterized by the product stream which is fed into the feeding gas stream prior to its entry into the flow tube is guided via a tube length and thereafter is immediately admitted into the flow tube together with the feeding gas.

12 Claims, 1 Drawing Figure

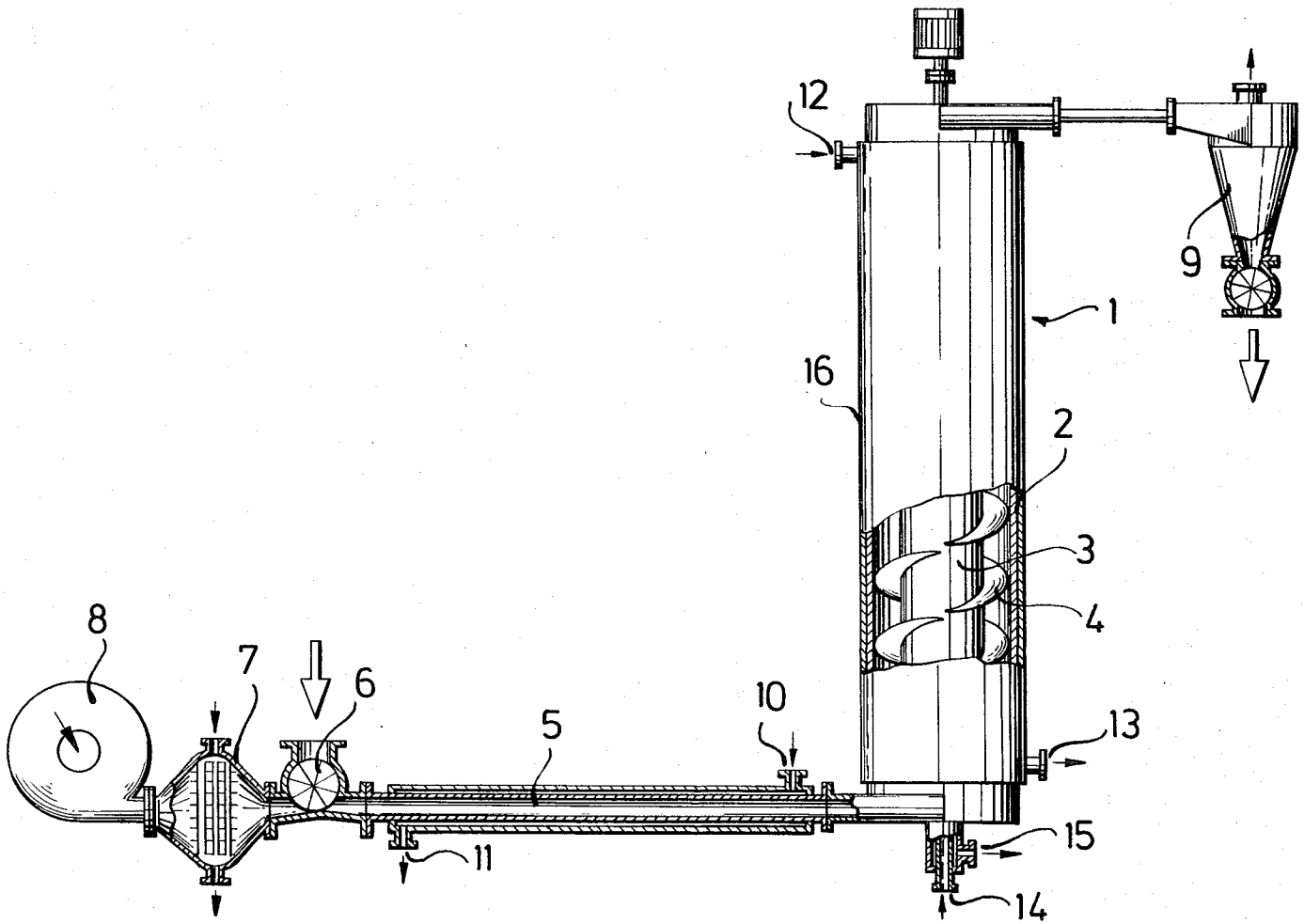
1
2
3
4
5
6
7
8
9
10
11
12
13
14
15
16

METHOD AND APPARATUS FOR DRYING MOISTURE-LADEN POWDER-LIKE PRODUCTS, PARTICULARLY OF STARCHES AND FLOURS

This application is a continuation of application Ser. No. 328,821 filed Dec. 9, 1981, now abandoned.

BACKGROUND OF THE INVENTION

The invention relates to a method for the drying of moisture-containing powder-like products, particularly starches and flours, using a drying device of the type mentioned in the preamble of patent claim 1, respectively an apparatus for carrying out this method.

Such a drying device is described in more detail in German patent No. 1,066,955. It is highly economical because the drying product is passed pneumatically in a helical path under contact with the heated inner drying wall through the drying device, whereby despite short dwell times over the entire dryer length of the path a high heat transmission to the drying product is obtained. Accordingly, the drying device known as a rotary tube dryer in practice has become widely accepted and suitable for many applications. Difficulties in use exist, however, in the case of those powder-like products which tend to stick when in moisture-laden condition, whereby the flow relationships in the dryer are substantially interrupted over the entire cross-section of the same.

In the treatment of extremely moisture-laden starch products, such as, e.g., corn starch or potato starch in the dryer, particularly the inlet region thereof clogs by the caking of these products at the inner wall of the dryer. Heretofore it was necessary to demoisturize such products in a convection dryer being supplied with large quantities of carrier gas, whereby the occurrence of clump-formation and product caking at the dryer wall was avoided.

Due to the high carrier gas quantities, however, these dryers are not only structurally expensive but also consume huge amounts of energy.

SUMMARY OF THE INVENTION

It has now been found that even extremely moisture-laden powder-like starches or flours can be treated in the rotary tube dryer if the product is first fed into the carrier gas stream and is then supplied to the rotary tube dryer with the carrier gas via a length of tube.

In case of appropriate construction of the preferably heatable tube length, the product has the adhesiveness removed from its surface, so that a product stream is introduced into the rotary tube dryer whose particles can be passed over the hot dryer wall without tending to bake on.

An object of the invention is thus to extend use of the known rotary tube dryer so that it also is capable of drying those products which in an extremely moist condition have a particular adhesiveness and which tend to form baked-on formations on the inner wall of the dryer.

The object is accomplished according to the invention by a method utilizing the above-described discovery.

With this method powder-like products with extreme moisture and adhesiveness can be dried in one stage in the rotary tube dryer down to the desired final moisture degree.

The operation of the rotary tube dryer, which is characterized as known by a helical flow path of the product and feed gas stream along the dryer wall, permits, even for short-time contact drying with defined product dwell time, the obtaining of a homogenous final moisture of all particles of the product stream.

Since this dryer type is characterized by a particularly intensive heat transmission between product stream and dryer wall and a product feeding is effected with a small feed gas quantity, its use is of particular importance for the aforementioned products because of the high effectiveness and low energy requirement.

The teaching according to the invention gives a new approach, contrary to the previously held assumptions, that it was not possible to dry adhesive products in a rotary tube dryer.

According to a feature of the invention, there is the production of a partial pressure drop between the feed gas and the product surface so that a part of the surface moisture is removed from the product. The released heat quantity based upon the cooling of the feed gas within the tube length serves for the surface drying of the product and thus the reduction of its adhesiveness.

The method fo the invention can be realized by a particularly simple apparatus used in connection with the rotary tube dryer. By feeding of the adhesive product into the feed gas stream the surface adhesiveness of the product is on the one hand reduced in the feed gas stream and furthermore an admission is obtained which is distributed over the inlet cross-section of the dryer. This effect is further improved by construction according to other features of the invention whereby the heat quantity which is freed via the pre-heated feed gas stream is additionally used for drying the product surface. The temperature of the feed gas stream and its total quantity can be controlled in known manner via a feed gas heater and a feed gas blower.

BRIEF DESCRIPTION OF THE DRAWING

Other objects, the features and advantages of the invention will be apparent from the following detailed description when read with the accompanying drawing whose sole FIGURE shows by way of example and not limitation the presently preferred embodiment of the invention.

DETAILED DESCRIPTION OF PREFERRED EMBODIMENT

A rotary tube dryer 1 of the known type consisting of a flow tube 2 in the interior of which there is a rotary tube 3 on which are fixed guide members 4 for the guidance of the product and feed gas stream along the inner wall. The flow tube 2, is at its inlet side, i.e., flow tube end, gas-tightly connected with a tube length 5. Via this tube length 5 the input of the feed gas stream mixed with powder-like product having a grain up to 6 mm is tangentially fed into the flow tube 2.

The flow tube 2 which has a double wall 16 is provided for the purposes of feeding or if required cooling with an inlet opening 12 and an outlet opening 13. The tube 3 is correspondingly heatable and coolable via inlet or outlet openings 14,15.

Just like the flow tube 2, the tube length 5 is also double-walled for the purposes of heating or cooling by means of a heat carrier and has an inlet opening 10 and an outlet opening 11 for the heat carrier.

The length of the tube length 5 is up to six meters with a pass-through cross-section which is maximum up to one-quarter of the free pass-through cross-section of the flow tube 2. The dimensions of the tube length 5 are dependent upon the flow rate and the quantity of the product stream as well as upon the starting moisture of the product passing through it. These dimensions can be readily empirically determined.

The tube length 5, which is preferably smooth-walled at its interior, is provided at its free end with a mechanical input device 6, for example with a wheel feeder or a metering screw. In addition, the tube length 5 may be connected, if needed, under interposition of a feed gas heater 7 with a feed gas blower 8.

The arrangement of the feeding device 6 is such that the product stream delivered by it is fed into the feed gas stream. On feeding into the previously heated feed gas stream the product stream has convectively removed from it a part of its surface moisture during its travel along the tube length, which is advantageous for the product to be treated. The feed gas stream which is continuously supplied via the tube length 5 and the flow tube 2 yields both in the tube length 5 and in the heated flow tube 2 a heat potential which is sufficient to maintain the fed-in product in flowable condition and bring it in the rotary tube dryer, for example in the case of treatment of corn starch, from a starting moisture of almost 45% to a final moisture of 12%.

The removal of the dried product from the flow tube is effected in the usual manner continuously via one or more separators 9 downstream of the rotary tube dryer 1.

While only one embodiment of the invention has been shown and described in detail, there will be many modifications and variations satisfying many or all of the objects of the invention while not departing from the spirit thereof or defined by the appended claims.

For example, without being detrimentally affected in its operation, the tube length 5 can be flanged both in vertical and in horizontal arrangements relative to the longitudinal axis of the rotary tube dryer 1 to the flow tube 2 of the same.

What is claimed is:

1. In a method for drying a moisture-laden powder-like product wherein the product is carried by a conveying gas through a rotary tube dryer having in its interior helical guide members extending from a central tube to define a helical path, the improvement comprising supplying a feeding gas stream, heating the supplied gas stream, directly feeding a stream of the moisture-laden powder-like product into the heated feeding gas stream, feeding the mixture of powder-like product and heated gas stream into a length of smooth, unobstructed tubing and guiding the formed mixture through the free cross-section of said tubing along the length thereof, heating said tubing to heat said mixture flowing therein whereby part of the moisture on the surface of the powder-like product is convectively removed and thereafter feeding said mixture tangentially into the rotary tube dryer whereby another part of the moisture of the product is removed.

2. The method of claim 1 wherein said mixture is tangentially fed into the rotary tube dryer.

3. Apparatus for drying a moisture-laden product comprising a tubular housing, a tubular core concentrically disposed within said tubular housing, a plurality of guide members helically extending from said tubular core whereby a helical guide path is established between said tubular core and said housing, outlet means at one end of said housing, inlet means at the other end of said housing, an interior smooth-walled tube length which is internally unobstructed having an outlet connected to said inlet means, means for controllably heating said smooth-walled tube length, a mechanical feed means, said tube length having an inlet directly connected to said feed means for introduction of the product to be dried thereinto, a feed gas source means remote from said mechanical feed means for feeding a gas stream into said tube length for advancement with the product to be dried therewith through said tube length to the tubular housing, and heater means connected between said mechanical feed means and said feed gas source means for heating the feed gas before it contacts said product.

4. Apparatus as claimed in claim 3 wherein said tube length is connected tangentially to said inlet means.

5. Apparatus as claimed in claim 3 wherein said feed gas source means is upstream of said mechanical feed means.

6. Apparatus as claimed in claim 3 wherein said tube length has an end remote from the inlet means of said housing, said heater means being connected to said remote end, said feed gas source means being connected to said heater means.

7. Apparatus as claimed in claim 6 wherein said tube length, said mechanical feed means, said heater means and said feed gas source means are arranged one after the other in the stated order.

8. Apparatus as claimed in claim 3 wherein said feed gas source means comprises a blower.

9. Apparatus as claimed in claim 3 wherein said tube length has a free cross-section which is less than one-quarter of the cross-section of the tubular housing.

10. Apparatus as claimed in claim 3 wherein said tube length and tubular housing are at an angle relative to one another.

11. Apparatus as claimed in claim 3 wherein said tube length and tubular housing are perpendicular to one another.

12. Apparatus as claimed in claim 11 wherein said tube length is horizontal and said tubular housing is vertical.

* * * * *